US005906403A

United States Patent [19]

Bestler et al.

[11] Patent Number: 5,906,403

[45] Date of Patent: May 25, 1999

[54] MULTIPOINT LOCK FOR SLIDING PATIO DOOR

[75] Inventors: William J. Bestler, Owatonna; Marcia K. Blom, Albert Lea; Clark A. Velzke, Medford, all of Minn.

[73] Assignee: Truth Hardware Corporation, Owatonna, Minn.

[21] Appl. No.: 08/854,341

[22] Filed: May 12, 1997

[51] Int. Cl.[6] ..... E05C 7/00

[52] U.S. Cl. ..... 292/26; 292/DIG. 46; 292/DIG. 60; 292/117

[58] Field of Search ..... 292/8, 26, 30, 292/35, 36, 40, 41, 116–118, 121–124, 130–132, 156, 159, DIG. 46, DIG. 56, DIG. 57, DIG. 60, DIG. 64, DIG. 53, DIG. 55, 31, 189, 302

[56] References Cited

U.S. PATENT DOCUMENTS

| | | | |
|---|---|---|---|
| 1,065,172 | 6/1913 | Riggs | 292/30 |
| 1,078,549 | 11/1913 | Northey | 292/40 |
| 1,515,611 | 11/1924 | O'Connor | 70/379 R |
| 1,585,689 | 5/1926 | Piggot | 292/118 |
| 2,498,508 | 2/1950 | Rudolph | 292/31 |
| 3,400,562 | 9/1968 | Bloss | 292/36 |
| 4,480,862 | 11/1984 | Fleming | 292/DIG. 46 |
| 4,547,006 | 10/1985 | Castanier | 292/159 |
| 5,120,094 | 6/1992 | Eaton | 292/DIG. 46 |
| 5,642,909 | 7/1997 | Swan | 292/DIG. 57 |

*Primary Examiner*—Darnell M. Boucher
*Assistant Examiner*—Gary Estremsky
*Attorney, Agent, or Firm*—Wood, Phillips, VanSanten, Clark & Mortimer

[57] ABSTRACT

A multipoint lock for securing a door to a door frame includes a tie bar longitudinally movable on the door with two latch members adjustably secured laterally relative thereto. The latch members are modular with hooks for selectively securing to the tie bar and other latch members. A metal face plate is securable over a door side groove with the tie bar movably secured to the plate in the groove at at least two locations by securing members extending through openings in the plate, tie bar and a plastic spacer. The securing members each include a longitudinal body member with parallel longitudinal sides cooperating with a tie bar slot to guide the tie bar. Rivets at ends of the securing members are secured to the plate. A link, pivotable about a substantially horizontal axis, has one arm driveably engaging the tie bar to selectively move the tie bar vertically toward a disengaged position. A handle member, pivotable about a substantially vertical axis on the door when pulled horizontally, driveably engages a second pivot link arm. A keeper base, securable to the door frame, selectively spaces two keeper hooks which cooperate with the latch members to secure the door to the frame. The keeper base is securable along one side to the frame and includes a projecting portion which visibly marks the frame when pressed thereagainst. An alignment guide supports the keeper hooks in a cooperative position with the latch members prior to securing to the frame.

15 Claims, 7 Drawing Sheets

22
26
48
56
92
94
24
42
210
40
212
144
28
62
50
52
68
72
76
66
60
130
106
46
70
58
156

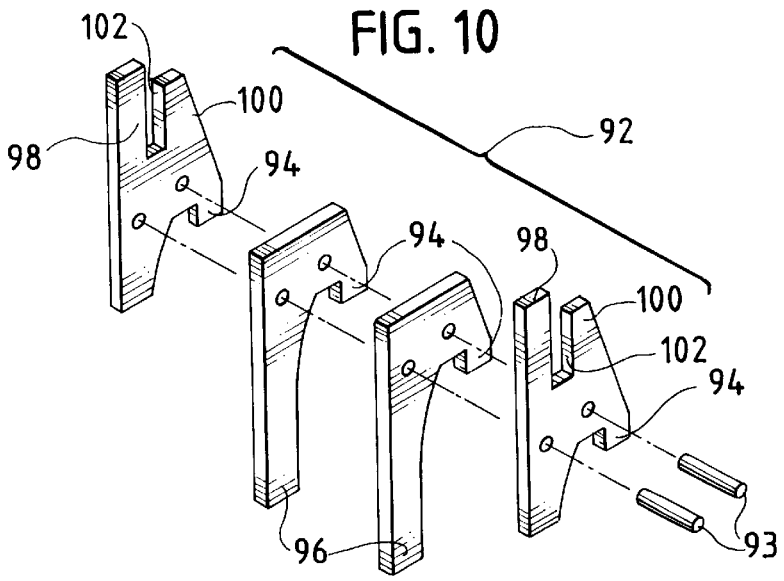
FIG. 10
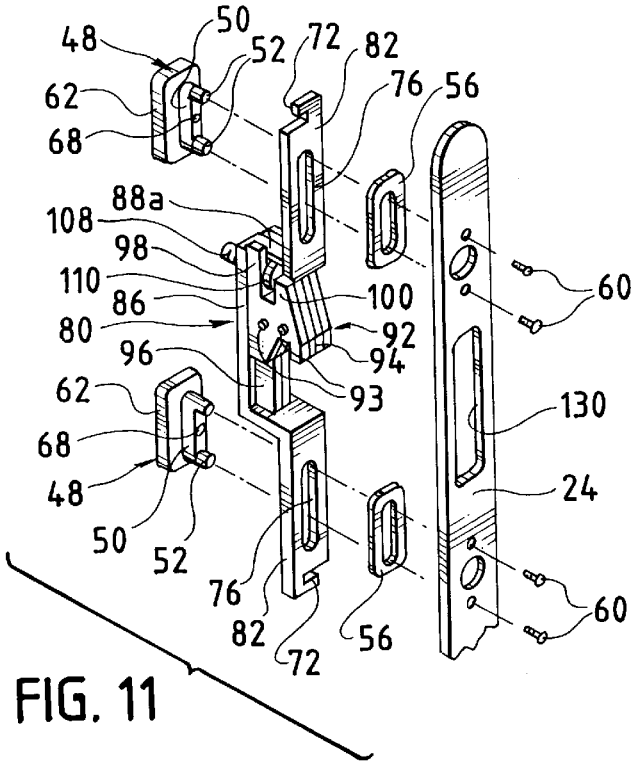
FIG. 11
FIG. 12
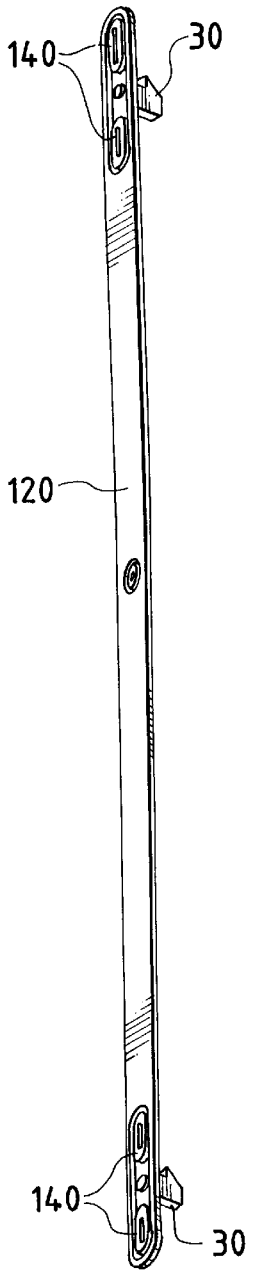

MULTIPOINT LOCK FOR SLIDING PATIO DOOR

BACKGROUND OF THE INVENTION

1. Technical Field

The present invention is directed toward closure locks and latches, and more particularly toward locks and latches for sliding patio doors.

2. Background Art

Patio doors are, of course, well known in the art, typically having a stationary door and a sliding door which allows entry into and exit out of the home. It is particularly desirable that such doors have a maximum amount of glass so as to provide the open feeling to the home which is sought in homes having such doors.

Commonly, such doors have been provided with a simple lock mechanism which includes a finger which grasps a keeper on the door frame when locked by an operator inside the home. While such locks provide some security, they can relatively easily be opened by an intruder by simply drilling into the housing of the lock and moving the finger free of the keeper.

Further, in some door lock structures, multipoint locking and latching mechanism are used to increase the security of the locking and latching. With such structures, maintaining a proper inventory of different components to allow for many different types of possible installations can be costly. Further, as a practical matter, requiring different components for different installations can result in costly mistakes and/or delays when the wrong components are supplied to a site.

Still further, installation of multipoint locking and latching mechanisms is significantly more difficult than with single latch points, as the difficulty in properly mounting the latch members to the door and the keepers to the frame, with each being properly aligned with the other, is multiplied. Of course, if installation is not done properly, the latch members may not be properly aligned and therefore may not properly latch when the door is closed. When that occurs with even just one of multiple point latches, a potential intruder may be able to gain access between the door and the frame to be able to manipulate the properly latched latch members and thereby defeat whatever security the door was intended to provide. When such misalignment occurs laterally, that is when the keeper and the latch member are in line but do not come close enough to latch together when the door is closed, as can occur if the door is not properly aligned in the frame, that failure may not be readily apparent to the home dweller who will therefore dangerously assume that they are more secure than they really are.

In addition, when such doors are closed without being locked, it is often not readily apparent whether the doors have been completely shut, or when they are slammed shut, they can rebound slightly to leave an open gap. In either event, the door does not serve as a good seal against hear (or air conditioning) loss, and further does not act as a barrier against entry of dirt, water, and insects into the home. In some instances, the door can be unintentionally gapped open enough that the locking finger will miss the keeper when seemingly locked, thereby providing the homeowner with a dangerous false sense of security.

Of course, patio doors are often used in environments which are particularly corrosive (such as in seaside dwellings), and corrosion can deteriorate the physical stability of the structure, as well as interfere with smooth operation of moving parts as is typically desired over the long expected life of such structures. For example, with multipoint locks in the prior art, a tie bar has typically been provided to connect spaced latch members, with the tie bar being guided for movement longitudinally to move the latch members between latching and unlatching positions. If the tie bar deteriorates, it will typically not move as smoothly as desired since its smooth sides will become rough and/or distorted.

Further, guides for tie bar movement which have been provided heretofore have also tended to deteriorate over time which can also result in binding. For example, a typical structure which has been used heretofore has been cylindrical or square guides fixed by a single centrally disposed pin, such as a rivet, where the guides ride in longitudinal slots in the tie bar. However, cylindrical pins have a very small, essentially tangential, surface area cooperating with the tie bar slot, which initially may tend to reduce whatever minimal frictional contact exists between the two components, but also tends to highly concentrate the stresses and wear over a very small area, with the result being that a significant amount of looseness can develop over the years with resulting degradation in the smooth and reliable operation of the structure. While square guides have also been used and therefore tend to spread out the area of contact with the tie bar, such square guides are also susceptible to twisting about their mounting rivet and therefore can themselves cause binding or otherwise wear down unevenly due to stress concentrations occurring at points when the guides are twisted.

Of course, smooth operation of moving parts can also be inhibited by binding of components confined in a very tight space, a particular problem when a structure such as a patio door latch must be very tightly and reliable mounted to a very limited space available in a door.

One patio door structure which has been used is shown in U.S. Pat. No. 4,362,328. This structure provides a secure lock for patio doors, but does not prevent the problems which can be encountered when the door is intentionally left unlocked—namely, the presence of unintentional gaps when closing the door through which heat and air conditioning can be lost and through which dirt, water and insects can enter the home.

Another patio door structure which has been used is shown in U.S. Pat. No. 4,973,091, which includes a lock and latch mechanism actuated by a slightly pivotable handle which addresses a few of the above discussed problems in the prior art.

The present invention is directed toward overcoming one or more of the problems set forth above.

SUMMARY OF THE INVENTION

In one aspect of the present invention, a multipoint lock for securing a door in a closed position relative to a door frame is provided, including a tie bar securable to a door for selected longitudinal movement between a securing position and a disengaged position, the tie bar having first and second latch members secured thereon with a selected spacing therebetween, an actuator for selectively moving the tie bar between the securing position and the disengaged position, and a longitudinal keeper base having first and second keeper hooks secured thereon with the selected spacing therebetween, the keeper base being securable to a door frame, whereby with a door in a closed position relative to a door frame the first and second latch members in a securing position cooperate with the first and second keeper hooks to prevent the door from being moved from its closed position.

In another aspect of the present invention, a multipoint lock for securing a door in a closed position relative to a door frame is provided, including a tie bar securable to a door for selected movement in a longitudinal direction between a securing position and a disengaged position, first and second keepers securable to a door frame with a selected spacing therebetween, and first and second latch members selectively engageable with the first and second keepers with a door in a closed position. The latch members are secured to the tie bar with the selected spacing therebetween, and are adjustably secured laterally relative to the longitudinal direction of movement of the tie bar.

In a preferred form of this aspect of the present invention, the latch members are secured by a fixed screw hole in the tie bar, a screw having a shaft threaded into the tie bar screw hole and further having a head and tool-engageable means for turning the screw to locate the screw head in a selected position, and a slot in the latch member receiving the screw head, whereby the latch member is selectively securable in a lateral direction relative the longitudinal direction of movement of the tie bar by the selected position of the head.

In a further aspect of the present invention, a multipoint lock for securing a door in a closed position relative to a door frame is provided, including a metal face plate securable over a groove in a side of a door, a metal tie bar longitudinally movable in a groove in a side of a door between a securing position and a disengaged position, and first and second latch members secured to the tie bar. The tie bar is secured to the metal face plate at at least two locations to allow longitudinal movement of the tie bar relative to the plate by a plastic spacer between the face plate and the tie bar, the plastic spacer preventing metal to metal contact between the face plate and the tie bar and including an opening therethrough, and a securing member extending through openings in the face plate and the tie bar and through the spacer opening, the securing member having heads at opposite ends thereof larger than the face plate and tie bar openings to secure the face plate, spacer, and tie bar therebetween.

In a preferred form of this aspect of the present invention, the tie bar has a first selected thickness and the spacer has a second selected thickness, and the securing member has a spacing member between one of the securing member heads and the face plate. The spacing portion has a thickness at least as great as the sum of the first and second selected thicknesses and extends through the openings in the tie bar and the spacer.

In yet another aspect of the present invention, a multipoint lock for securing a door in a closed position relative to a door frame is provided, including a longitudinal tie bar having opposite ends and securable to a door for selected longitudinal movement between a securing position and a disengaged position, the tie bar having structure on both ends for securing to a latch member, an actuator structure for selectively moving the tie bar between the securing position and the disengaged position, and first and second latch members each having structure on one end for cooperating with the tie bar securing structure to secure the first and second latch members to the tie bar opposite ends for longitudinal movement with the tie bar.

In a preferred form of this aspect of the present invention, a third latch member is provided, wherein the latch members on opposite ends have interengaging hooks with the first latch member having the interengaging hook on one end cooperating with the tie bar securing structure and the third latch member having the interengaging hook cooperating with the interengaging hook on the other end of the first latch member to secure the first and third latch members for longitudinal movement with the tie bar.

In a still another aspect of the present invention, a control for a multipoint lock for securing a door in a closed position relative to a door frame is provided, including a face plate securable over a groove in a side of a door, a tie bar longitudinally movable in a groove in a side of a door between a securing position and a disengaged position, the tie bar having a first selected thickness and first and second latch members secured thereon, and structure for securing the tie bar to the face plate at at least two locations to allow longitudinal movement of the tie bar relative to the plate, the securing structure at each of the at least two locations including a longitudinal slot in the tie bar and a longitudinally oriented securing member. Each of the securing members has a body member extending substantially between opposite longitudinal ends of each securing member, the securing member body member being received in the tie bar longitudinal slot with parallel longitudinal sides cooperating with the tie bar longitudinal slot to guide the tie bar for longitudinal movement, and first and second rivet members at opposite longitudinal ends of each of the securing members and secured to the face plate with each of the body members having its parallel longitudinal sides substantially parallel to the direction of longitudinal movement of the tie bar relative to the face plate.

In a preferred form of this aspect of the present invention, the tie bar longitudinal slots are longer than the body members by a selected distance which is at least as great as the distance of longitudinal movement of the tie bar.

In another preferred form of this aspect of the present invention, the securing member body members form bushings, and the control is secured to a side of a door by securing screws extending through the face plate and the body member bushings and into a door.

In yet another aspect of the present invention, a releasable multipoint latch for securing a door in a closed position relative to a door frame is provided, including a tie bar securable to a door for selected longitudinal vertical movement between a securing position and a disengaged position, the tie bar having first and second latch members secured thereon with a selected spacing therebetween, a pivot link pivotable about a substantially horizontal axis, the link having first and second arms, the first arm being drivably engageable with the tie bar to selectively move the tie bar vertically toward its disengaged position when the pivot link is pivoted in a first direction about its horizontal axis, a handle member securable to a door for slight pivoting in a first direction about a substantially vertical axis when the handle member is pulled horizontally toward opening a door, a structure for drivably engaging the handle member with the pivot link second arm whereby pivoting of the handle member in the first direction about its vertical axis pivots the pivot link in the first direction about its horizontal axis, first and second keeper hooks securable to a door frame with the selected spacing therebetween, and structure biasing the tie bar toward the securing position. With this aspect of the invention, when a door is in a closed position relative to a door frame, the first and second latch members in the securing position cooperate with the first and second keeper hooks to prevent the door from being moved from its closed position.

In a preferred form of this aspect of the present invention, the biasing structure is a spring biasing the handle to bias the drivably engaging means to bias the pivot link toward pivoting in a direction opposite the first direction to bias the tie bar toward the securing position.

In still another aspect of the present invention, a structure for assisting in properly mounting a keeper hook to a closure frame is provided, so that the keeper hook when mounted to a closure frame cooperates with a latch mechanism mounted on the side of a closure slidably movable in the closure frame to a closed position in with the latch mechanism cooperates with the keeper hook. The assisting structure includes a base for a keeper hook, the base being securable along one side to a closure frame and including a portion projecting from the one side for visibly marking a closure frame when the base is pressed against the closure frame, and an alignment guide for supporting the keeper hook in a cooperative position with the latch mechanism when the base is not secured to a closure frame.

In a preferred form of this aspect of the present invention, the alignment guide includes a U-shaped member having two upright legs connected by a bottom cross member and an outer surface substantially conforming to a latch member housing opening, whereby the guide is received in the housing opening and a hook is received between the two U-shaped member legs and is supported by the bottom cross member in a position substantially cooperating with a movable latch.

It is an object of the invention to provide a structure which provides secure latching and locking against forced entry through the patio door.

It is another object of the invention to provide a patio door which can be automatically latched when closed, and yet can still be easily operated to open the door when desired, even when the operator is panicked in an emergency.

It is a further object of the invention to provide a patio door latch and lock which provides smooth, reliable operation over a long useful life.

Yet another object of the invention is to provide a patio door latch and lock which has only minimal degradation of the components notwithstanding the long expected useful life of the structure.

Still another object of the invention is to provide a patio door latch and lock which can be securely mounted in a limited space on the side of a door without binding the moving components or otherwise interfering with the smooth operation of the structure.

It is still another object of the invention to provide a patio door latch and lock which can be easily and accurately installed. It is therefore still further an object of the present invention to provide a method and related structure for assisting in readily installing the latch members and keeper hooks so as to ensure proper alignment therebetween, and subsequent proper latching and locking without dangerously misleading the dwelling occupant as to the security of the door.

It is yet another object of the invention to provide a patio door latch and lock which can be easily installed in a variety of patio doors without significantly cutting down on the window space in the door, and which can be readily used in installations desiring different numbers of locking and latching points.

Yet another object of the invention is to provide a patio door lock and latch which will operate smoothly over long periods of time notwithstanding the harsh environment in which the structure may be used.

Various features and combinations of features of the present invention accomplish one or more of the above objects.

BRIEF DESCRIPTION OF THE DRAWINGS

FIG. 10 is an exploded view of a portion of the latch member of FIGS. 7–9;

FIG. 11 is an exploded illustration of the connection of the latch members to the face plate, substantially as also shown in FIG. 2;

FIG. 12 is a perspective view of the keeper structure of the present invention;

DESCRIPTION OF THE PREFERRED EMBODIMENT

Figures 1, 2, 3, 4:
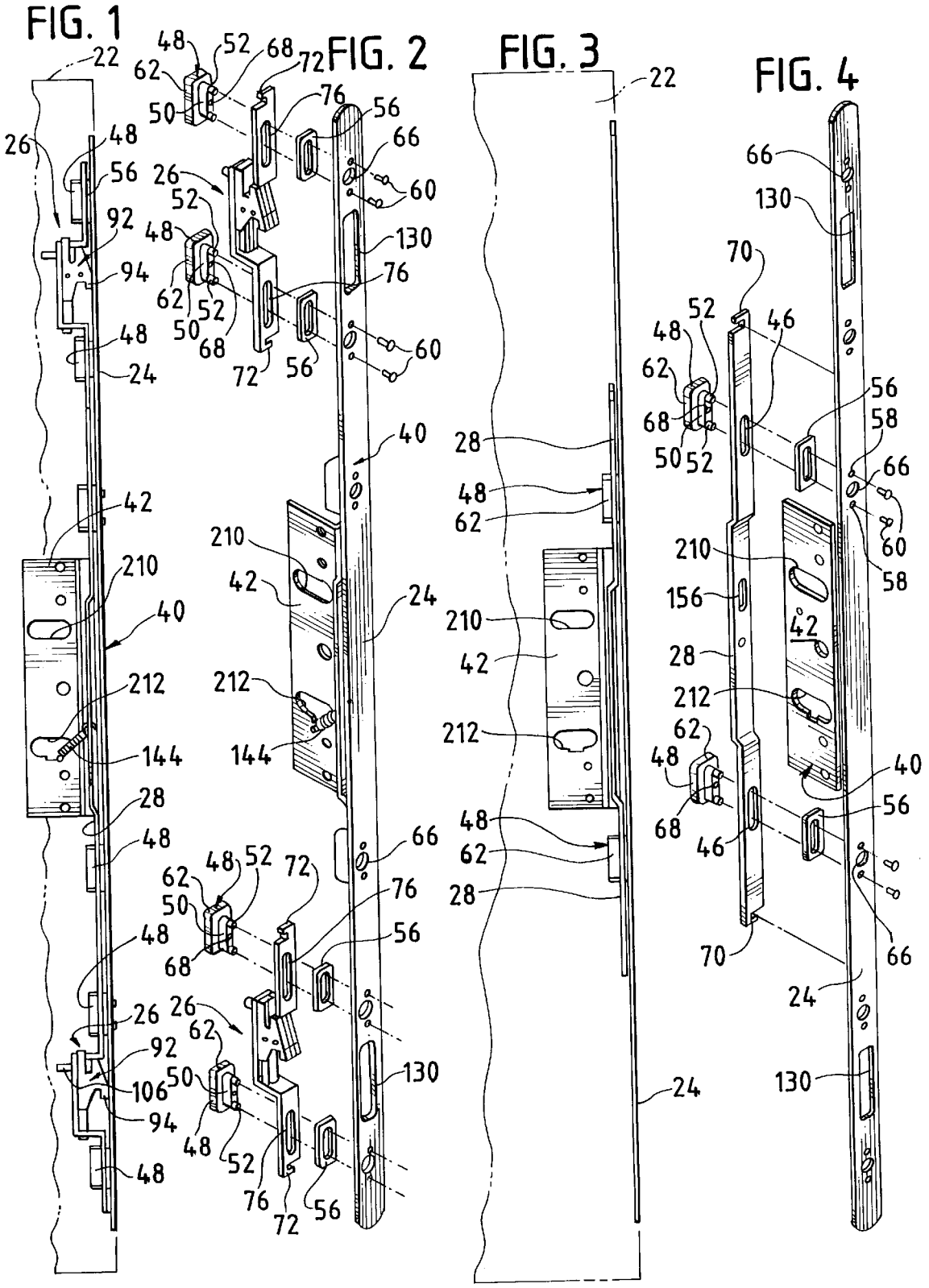
FIG. 1 is a front view of a locking mechanism according to the present invention as installed in the side of a door.
FIG. 2 is a perspective view of the face plate with an exploded illustration of the connection of latch members to the face plate.
FIG.3 is a front view similar to FIG. 1, but showing only the face plate and tie bar portions of the locking mechanism.
FIG. 4 is an perspective view of FIG. 3 with an exploded illustration of the connection of the tie bar to the face plate.

The invention embodies a multipoint lock 20 such as would be used for a sliding door 22 (shown in phantom in FIGS. 1 and 3) as commonly used with patios. Broadly speaking, this lock 20 has a face plate 24 secured to the side of a door 22 and supporting latch members 26 (see especially FIGS. 7–11) connected by a tie bar 28 (see especially FIGS. 1 and 3–4) for vertical movement between latching and releasing positions. When the door 22 is in a closed position against a frame, the latching members 26 when in the latching position interfere with keepers 30 (see FIG. 12) secured to the frame so as to interfere to prevent opening of the door 22 away from the frame.

Operation of the door 22 is controlled by handles 32*a*, 32*b* (on both sides of the door 22) which cooperate with housings 34*a*, 34*b* secured to the door 22 and face plate 24 (see especially FIGS. 13–18).

Generally speaking, the structure as referred to above operates in a well known manner, with the door 22 latching shut automatically upon closing, and being openable again by a person causing the latch members 26 to move vertically to disengage from keepers 30 on the frame and then simply pulling the door 22 open.

Numerous improvements are provided, however, for this basic structure to provide significant advantages over prior art door latch mechanisms. Detailed descriptions of the various components of the preferred embodiment of this multipoint lock 20 providing such numerous and varied advantages are therefore set forth below.

Referring first to the face plate 24, latch members 26, and tie bar 28, FIGS. 1–4 show a weldment assembly 40 comprising a longitudinal face plate 24 adapted for securing to the side of a door 22. As will be apparent, the face plate 24 will form a substantially flat side to the door 22, covering a groove which may be formed in the side of the door 22 as is known to provide operating room for the lock assembly as will become apparent.

A base flange plate 42 is secured (as by welding) perpendicular to the face plate 24 and is generally receivable in a slot in the door 22 to further secure the weldment assembly 40 in the door 22 and also to provide a base for properly securing other components of the lock 20 as further described below.

A centrally disposed tie bar 28 is advantageously secured to the face plate 24 for reliable and easy vertical movement as required for operation of the lock 20 as previously discussed. Referring especially to FIG. 4, the tie bar 28 has a pair of spaced slots 46 through which suitable guide bushings 48 extend. Specifically, each of the guide bushings 48 has a longitudinally extending guide portion 50 which is receivable in one of the slots 46, with a pair of generally cylindrical bushing portions 52 extending therefrom. As will be apparent, the length of the guide portion 50 is generally less than the length of the tie bar slot 46 by an amount at least equal to the required amount of vertical motion of the tie bar 28 for operation of the lock 20.

The bushing portions 52 extend through a spacer guide 56 and are positioned in alignment with screw holes 58 in the face plate 24, and suitable screws or other fasteners 60 extend through the screw holes 58 into the bushing portions 52 to secure the guide bushings 48 to the face plate 24. The guide portion 50 and bushing portions 52 therefore provide a reliable spacing between the face plate 24 and the head 62 of the guide bushing 48. That is, by forming the guide portion 50 and bushing portions 52 so as to provide a given lateral dimension which is slightly greater than the combined thicknesses of the tie bar 28 and the spacer guide 56, frictional binding of the tie bar 28 and spacer guide 56 with the face plate 24 can be prevented. Further, by providing a longitudinally aligned and longitudinally extending guide portion 50, the area of contact between the guide portion 50 and the component being guided (that is, the tie bar 28 and the contact with the sides of the slot 46) are maximized when compared to prior art structures in which the tie bar is guided by round pins. Therefore, areas of high stress concentrations (as occur with the small areas of only tangential contact with round guide pins) are avoided, and undesirable wear of the guide portion 50 is thereby minimized to ensure that a reliable, precise operation will be provided over many years of useful life. Further, by reliably longitudinally positioning the guide bushings 48 relative to two points by the two screws 60, twisting of the bushings 48 are prevented and therefore binding of the bushings 48 as could occur with prior art square guides mounted about a single central axis is also avoided.

The spacer guide 56 is preferably made of a non-metallic, non-corrosive material such as a suitable plastic which thereby eliminates contact between metal components (that is, the tie bar 28 and the face plate 24). Avoiding such contact not only reduces friction but also avoids corrosion which can occur over time between two contacting metal surfaces, and thereby avoids not only binding which might interfere with smooth operation of the lock 20 but also degradation of components which could hurt the integrity of the lock 20 over time.

In the preferred embodiment, the face plate 24 and guide bushings 48 are also provided with aligned mounting holes 66, 68 (see especially FIG. 4) for mounting the structure to a door 22. Specifically, as previously mentioned, the lock 20 is generally mounted in a slot in the side of a door 22, and may be secured therein by suitable fasteners such as screws which extend through the mounting holes 66, 68 into the door 22 itself. Such screws may be very tightly fastened to rigidly secure the face plate 24 to the door 22 without causing binding of the components. Since, as previously mentioned, the guide portion 50 and bushing portions 52 provide a reliable spacing between the bushing head 62 and face plate 24, no matter how much the mounting screws are tightened it will not interfere with the free longitudinal movement of the tie bar 28 as is desired for smooth operation of the lock 20.

The ends of the tie bar 28 include connecting hooks 70 (see FIG. 4). Latch members 26 are similarly provided with matching connecting hooks 72 (see FIGS. 2 and 7–9) at both ends. The latch members 26 are also secured to the face plate 24 by use of guide bushings 48, spacer guides 56 and suitable fasteners such as screws 60 (all of which are essentially identical to those components used with the tie bar 28) in conjunction with guide slots 76. By providing such connections adjacent to the top and bottom of the tie bar 28 and the latch members 26, the lateral orientation of those components can be reliably established so that they can be operably connected by merely overlapping the hooks 70, 72 in a vertical plane without needing to otherwise directly secure the tie bar 28 and latch members 26 against lateral movement. Therefore, this reliable connection may be established in a minimal amount of space (requiring only the thickness of the components) as is important in the relatively limited space along the side of the door 22.

Figure 4A:
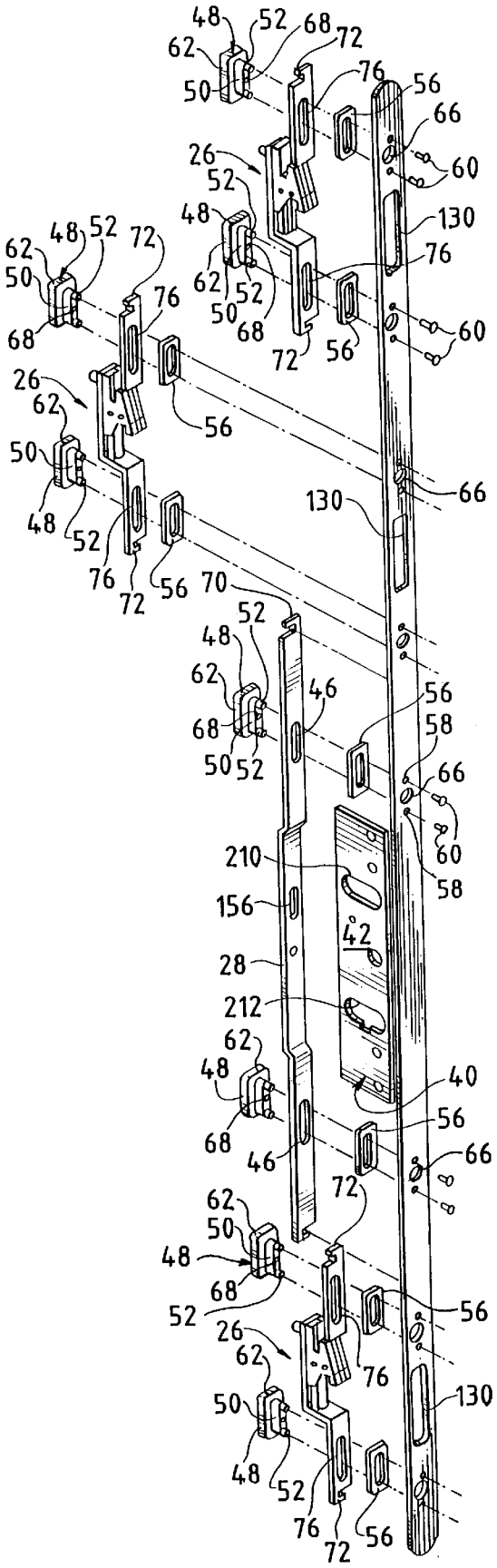
FIG. 4A is a perspective view of an exploded illustration of the connection between the tie bar, latch members, and face plate in an embodiment having three latch members.

Further, it should be understood that the tie bar 28 and latch members 26 are essentially modular in construction, so that any number of latch members 26 could be connected end to end to one another. For example, in a tall door, it might be desired to have more than two latch points such as generally illustrated in the figures. In that case, such a configuration could be provided with only a specially made face plate—taller, naturally, to match the taller door, and with additional sets of screw and mounting holes 58, 66 to accommodate an additional latch members 26. For example, a configuration substantially the same as shown in the drawings could be used, but with a third latch member added to the top of the lock 20, the connecting hook 72 at the bottom of the third latch member readily connect to the hook 72 at the top of the latch member 26 therebeneath (see FIG. 4A). Inventory and manufacture costs are thereby minimized, as no special additional latch members, guide bushings, spacer guides, etc. are required. Further, assembly and installation costs are minimized as nothing different or unusual needs to be done even for unusual installations.

FIGS. 7–11 show a preferred construction of the latch members 26, including a carrier 80 having upper and lower flange portions 82 each with connecting hooks 72 and guide slots 76 as previously discussed. With the modular construction such as discussed above, the carrier 80 essentially is a part of the tie bar 28 when the connecting hooks 70, 72 engage to secure them together.

A U-shaped portion 84 connects the flange portions 82, and includes an offset back portion 86 connected to laterally extending portions 88, one of which 88*a* is narrower than the back portion 86 and flange portions 82 due to notches 90 formed in both sides thereof. An opening 91 is also provided in the other laterally extending portion 88.

The latch 92 may be formed of laminated sheets of metal (suitably secured together in any number of manners, such as by rivets or pins 93, or by welding). In the preferred embodiment shown in the figures, the latch 92 is formed of four sheets of metal (see especially FIG. 10), with all four sheets forming a latch hook 94, two middle sheets forming a lower leg 96, and two outer sheets forming a pair of upper legs 98, 100 defining a slot 102 therebetween.

The lower leg 96 is received in the opening 91 in the bottom laterally extending portion 88 of the carrier 80.

One pair of upper legs 98 are longer than the other pair 100 so that, when assembled with the carrier 80, the upper legs 98 are located in the notches 90 of the carrier narrow laterally extending portion 88*a* to secure the latch 92 to the carrier 80 while also allowing for lateral relative movement as discussed below.

Specifically, a screw 106 is used to adjustably secure the latch 92 to the carrier 80. The shaft 108 of the screw 106 is disposed between the metal sheets forming the latch upper legs 98, and the head 110 of the screw is located in the slot 102 between the upper legs 98, 100. The screw shaft 108 is threaded into a threaded hole 112 in the carrier offset back portion 86.

It should thus be appreciated that the latch 92 will be reliably secured to the carrier 80, with sideways motion prevented by the engagement of the lower leg 96 in the opening 91 and the upper legs 98 with the notched sides of the laterally extending portion 88*a*. Further, lateral adjustment of the latch 92 can be accomplished by simply turning the screw 106 (which can be accessed even after installation in a door 22 by inserting a suitable tool (such as a screwdriver) through the latch opening in the face plate 24 and between the latch legs 100 so as to drivably engage the screw head 110. Turning of the screw 106 will effectively change the spacing between the screw head 110 and the carrier offset back portion 86 and the screw head 110 will carry the latch 92 with it so as to effectively move the latch 92 laterally relative to the carrier 80.

Accordingly, during installation of the lock 20 on a door 22, or even years thereafter, the latch member 26 can be adjusted to accommodate changing conditions and ensure that the latch member 26 will reliably, securely, and tightly engage the matching keepers 30 (if, for example, the door 22, frame, keeper 30 or other components were to shift over time due to bending or warping) to provide continued, long term ideal locking and latching. If a latch 92 and keeper 30 were to be misaligned later for any reason so that they do not to hook or latch together when the door is closed, a potentially dangerous condition in which the door would not be securely shut could exist. The adjustability provided by the adjustment by the screw 106 can be used to prevent such a dangerous situation from arising.

Referring now specifically to the keepers 30, FIG. 12 shows a longitudinally extending keeper base 120 having the keepers 30 rigidly fixed thereon at a selected spacing. Specifically, in a typical installation with two latch members 26 and two keepers 30, the keeper base 120 spaces the keepers 30 a distance corresponding to the design spacing of the latches 92 provided by the tie bar 28 and the carriers 80. By using such a construction, the keepers 30 can be precisely located for proper orientation with both of the latches 92, without concern that one or more of the keepers 30 might be improperly installed and therefore not provide ideal locking at all points along the side of the door 22. Given the previously discussed modular construction of the latch members 26 and tie bar 28, it will be readily appreciated that only a few different keeper base configurations need be required for different installations to still provide the ideal operation of the present invention (for example, a keeper base having two keepers at the top and one keeper at the bottom, all with readily determinable, standard spacing, could be provided for use with locks desiring three connection points).

The keepers 30 also include bevelled upper front surfaces 122 as is understood in the art. When the door 22 is shut, the latch hook 94 will engage the bevelled surface 122 of the associated keeper 30 and cause the latch members 26 and tie bar 28 to be moved up as the door 22 is further closed, until the latch hook 94 clears the top of the keeper 30. Further closing of the door 22 finally overlaps the hooks of both the latch members 26 and keeper 30 sufficiently that the latch members 26 can fall down, with the latch hook 94 and keepers then overlapping so as to prevent opening of the door 22 away from the frame as is well understood in the art.

Figure 12A:
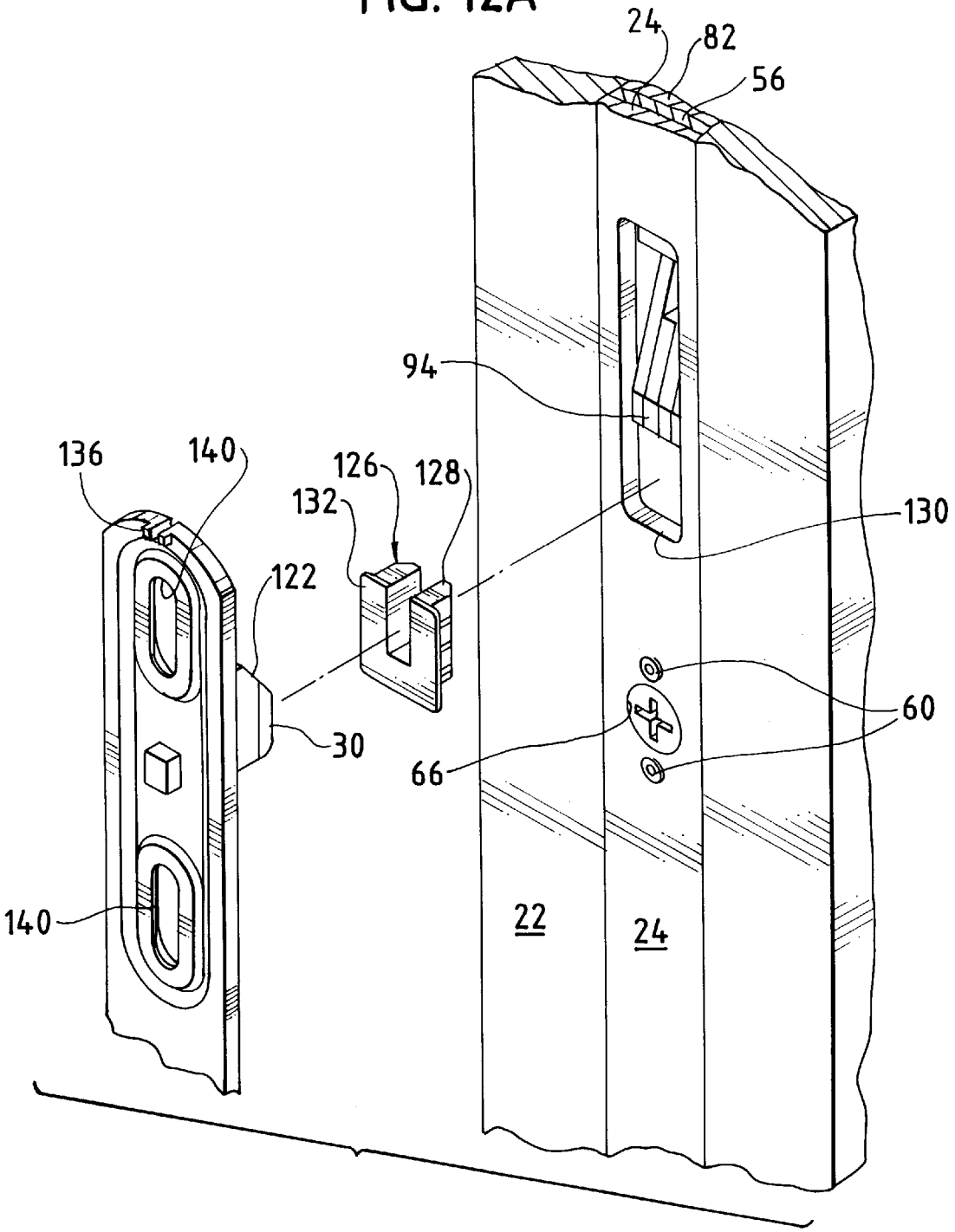
FIG. 12A is an exploded perspective view illustrating an improved structure for properly mounting the keeper to a door frame.

FIG. 12A illustrates a structure and method for ideally mounting the keepers 30 to the door frame. Specifically, a generally U-shaped alignment guide 126 is provided, having a body 128 generally shaped to fit in the bottom of the face plate opening 130 for the latch 92, and a front face outer flange 132 which keeps the guide 126 from moving entirely through the opening 130. The slot in the middle of the guide body 128 is adapted to receive the keeper 30 therein so that, prior to mounting the keeper base 120 to the door frame, the keepers 30 and base 120 are first brought into a latching type engagement with the latches 92. The alignment guide 126 thus ensures that in this assembly, the keepers 30 are positioned so that they are oriented precisely as desired relative to the face plate 24, that is, midway between the sides of the opening 130 with the bottom of the keeper 30 spaced up from the bottom of the opening 130. It will be appreciated that without the alignment guide, the orientation of the keepers 30 would be directly against the bottom of the face plate opening 130, and perhaps offset to one side or another.

With the keepers 30 and keeper base 120 thus mounted to the latches 92 mounted to the door 22, the door 22 may then be slammed shut against the door frame. A tang 136 is preferably provided on the back face of the keeper base 120 at both the tops and bottom, so that when the door 22 is slammed shut, the tangs 136 will make a small mark in the frame. Once this is done, the keepers 30 may be detached from the door 22 and then easily and precisely mounted on the frame, using the marks formed by the tangs 136 as guides for positioning the keeper base 120 on the frame. A small gap may be provided between two tangs 136 as shown in FIG. 12A to provide a sight line behind the keeper base 120 during mounting for precisely orienting the keeper base 120 so that the tangs 136 are aligned with the marks made by the tangs 136.

Longitudinal mounting holes 140 are preferably provided in the keeper base 120, so that suitable connectors such as screws can be used to secure the keeper base 120 to the frame, while also allowing for minor vertical adjustments of the keeper base 120 (if, for example, the screw holes are not precisely drilled during installation, or the screws themselves are not oriented properly during installation, or should warping or settling of components require realignment at a later date.

It should be appreciated that in typical installations, the latch members 26 will be in their latching position when at or near the bottom of their vertical range of motion. The weight of the components will help to ensure this. However, a tension spring 144 secured between the tie bar 28 and the base flange plate 42 (see FIGS. 1–2) provides a further positive biasing force to help ensure that the latch members 26 will be down unless operated upon to move it to an unlatching position as described below.

Figure 5:
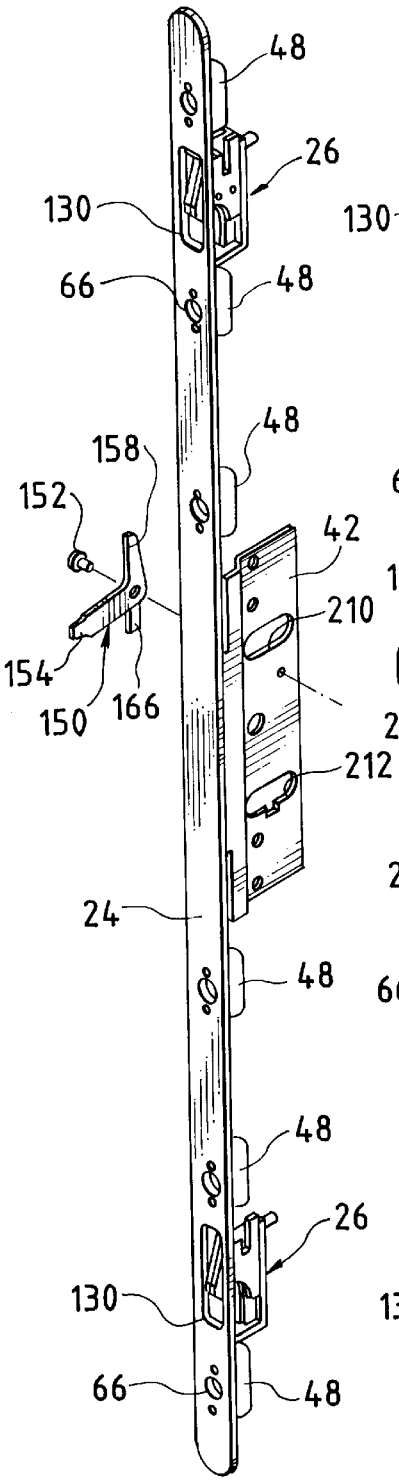
FIG. 5 is a perspective view of the locking mechanism with an exploded illustration of the connection of the pivot link to the face plate.

The basic structure for operating the tie bar 28 and attached latch members 26 to move them up when desired for unlatching/unlocking is shown in FIG. 5. Specifically, in the preferred embodiment, an arm link 150 is suitably secured, as by a rivet 152, for pivoting relative to the base flange plate 42. The arm link 150 includes a driving arm 154 which is received in a slot 156 (see FIG. 4) in the tie bar 28 so that pivoting of the arm link 150 about the rivet 152 will cause the tie bar 28 to move vertically. The arm link 150 also includes a control arm 158 which may be engaged as discussed below to provide for reliable and easy unlatching of the lock 20 by causing controlled pivoting of the arm link 150.

Figure 6:
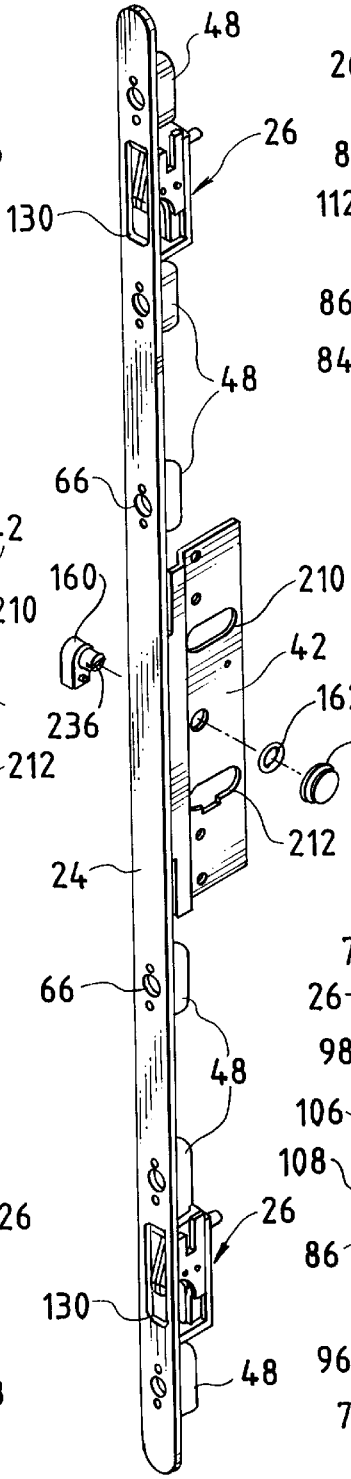
FIG. 6 is a perspective view similar to FIG. 5, but with an exploded illustration of the pivot link lock connection to the face plate.
Figure 9:
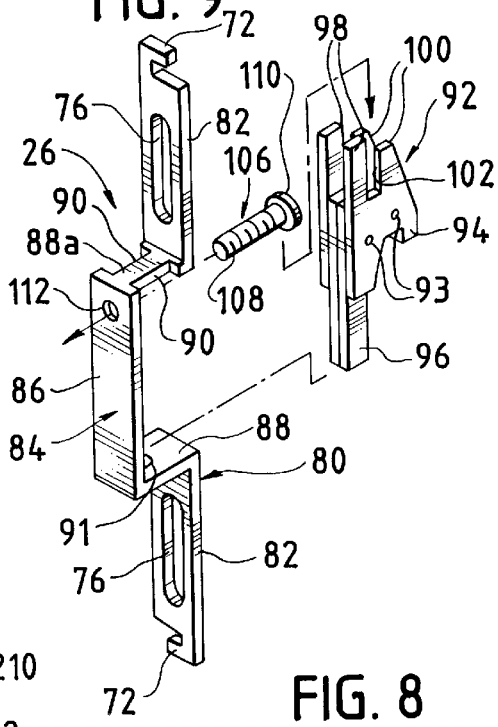
FIG. 9 is an exploded perspective view of the latch member of FIG. 7.
Figure 8:
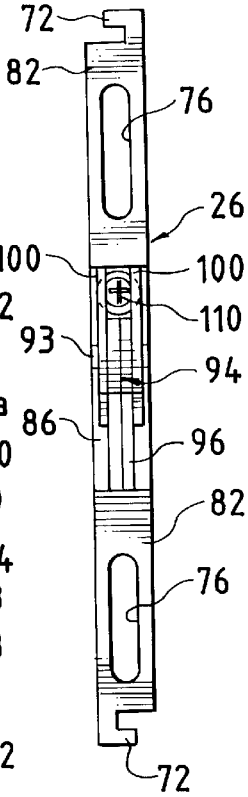
FIG. 8 is a side view (the right side as would be viewed in the orientation of FIG. 1) of the latch member of FIG. 7.
Figure 7:
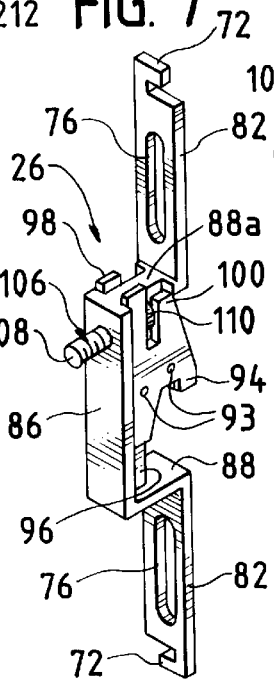
FIG. 7 is a perspective view of a latch member usable with the locking mechanism of the present invention.

A cam lock 160 is also pivotally secured in a suitable manner to the base flange plate 42 as shown in FIG. 6, for example, by a wave washer 162 and retaining ring 164. The cam lock 160 is shown down in FIG. 6 in an unlocked position. By pivoting the cam lock 160 upwardly, the cam lock 160 will be in a position in which it will block the locking arm 166 (see FIG. 5) on the arm link 150 to prevent clockwise pivoting of the arm link 150 as viewed in FIG. 5, which thereby prevents the connected tie bar 28 and latch members 26 from moving up away from their latching/locking position. Thus, the cam lock 160 can be used to selectively lock the latch members 26 and tie bar 28 in a latched position, effectively locking the door 22 in its closed position when desired.

Figure 14:
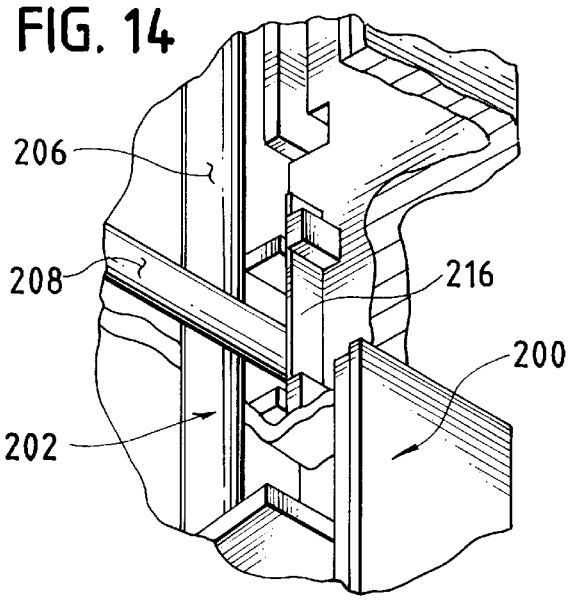
FIG. 14 is an enlarged perspective view of the circled portion of FIG. 13.
Figure 13:
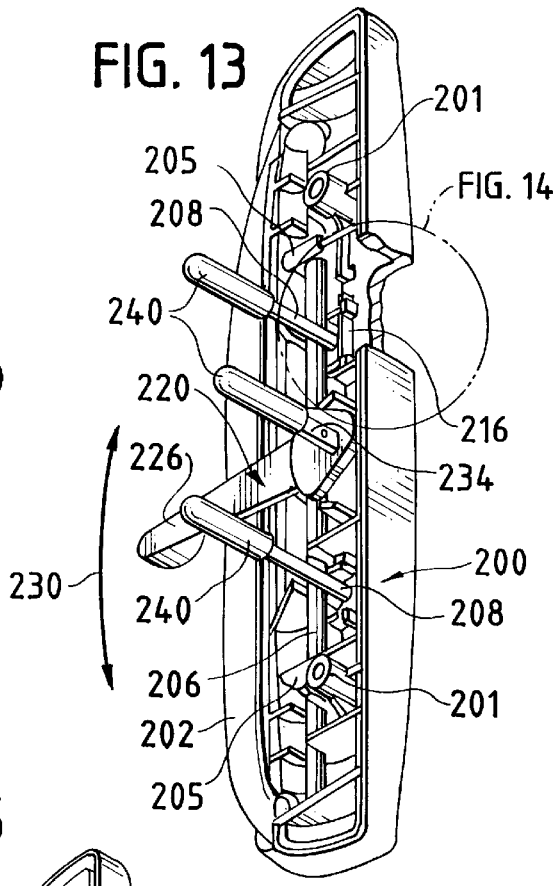
FIG. 13 is a perspective view of one side of the handle and operator housing structure usable with the locking mechanism of the present invention.
Figure 15:
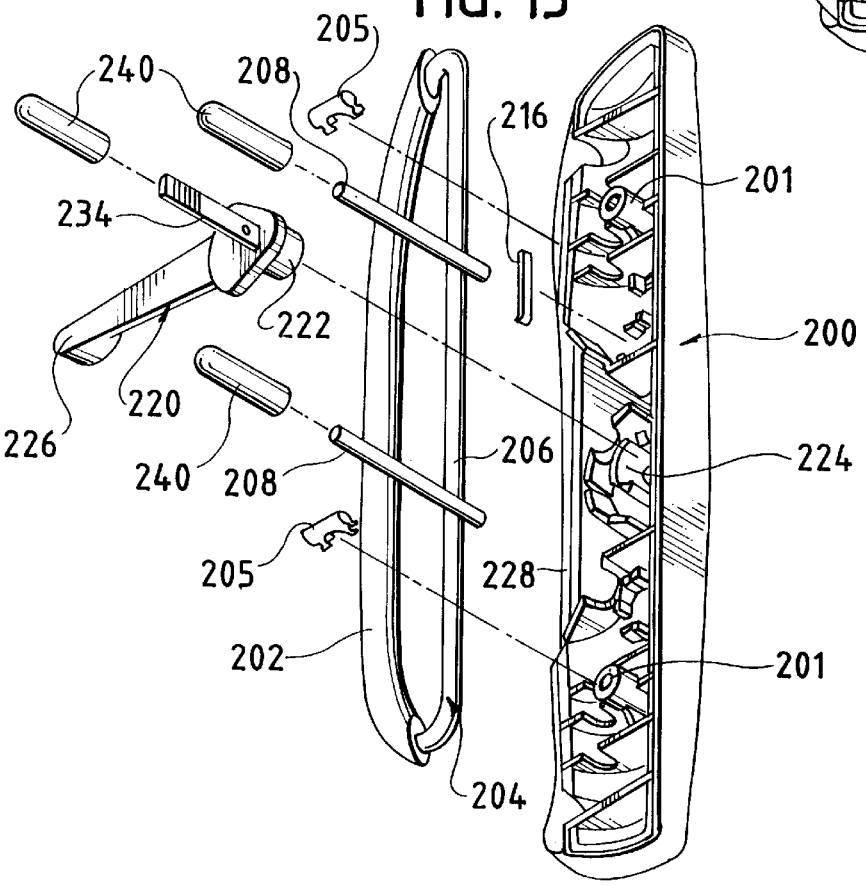
FIG. 15 is an exploded perspective view of the handle and operator housing structure of FIG. 13.
Figure 16:
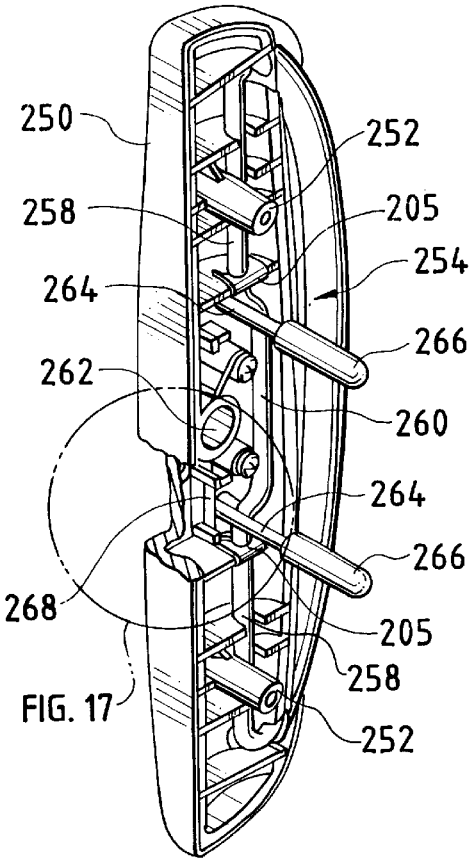
FIG. 16 is a perspective view similar to FIG. 13, but showing the other side of the handle and operator housing structure.
Figure 17:
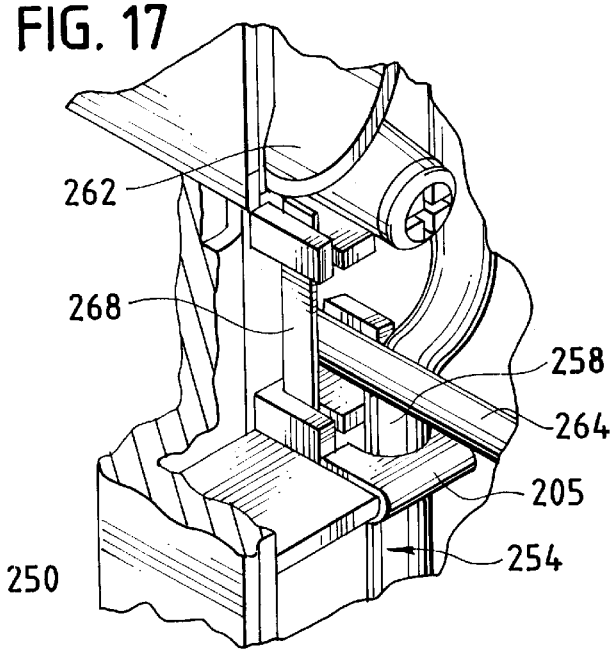
FIG. 17 is an enlarged perspective view of the circled portion of FIG. 16.
Figure 18:
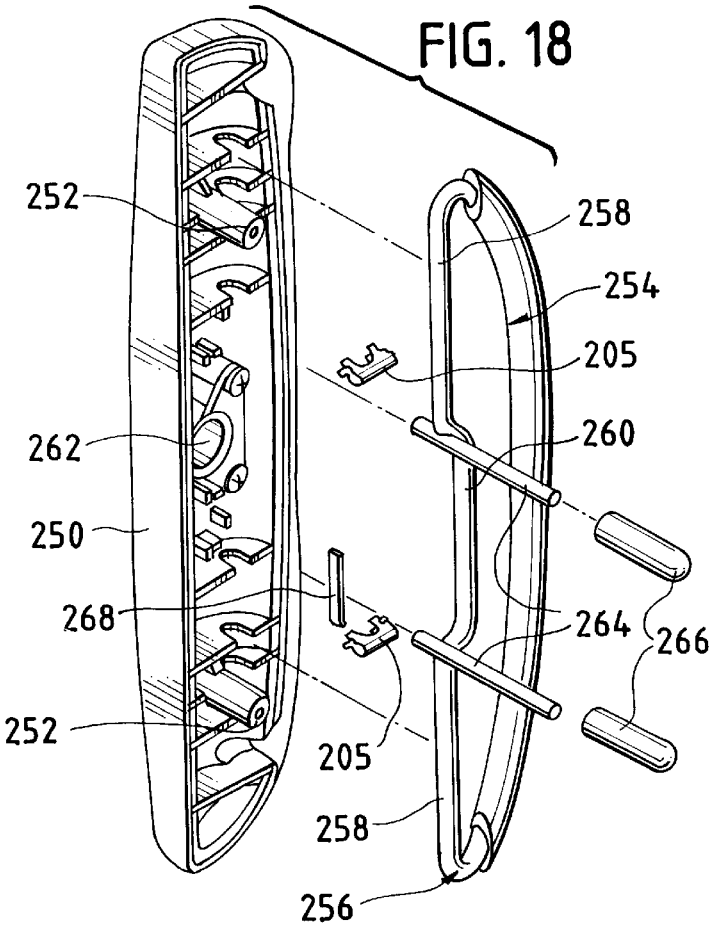
FIG. 18 is an exploded perspective view of the handle and operator housing structure of FIG. 16.

FIGS. 13–18 show the handle and housing structure for controlling the door 22 and the tie bar 28 and latch members 26, with FIGS. 13–15 illustrating the preferred embodiment of the handle and housing structure for use on the interior side of the door 22 and FIGS. 16–18 illustrating the preferred embodiment of the handle and housing structure for use on the exterior side of the door 22.

Referring first to the structure on the interior side of the door 22, a decorative housing 200 is provided with suitable reinforcing ribs therein for maintaining the structural integrity of the housing 200. Bosses 201 are provided in the housing 200 for use with screws for securing the housing 200 to the door 22 as described in greater detail below.

As best shown in FIG. 15, the handle 202 is a looped member, including a reduced diameter portion 204 received in the housing 200, and more particularly having a longitudinally extending portion 206 disposed in suitable slots in the housing reinforcing ribs so as to permit slight pivoting of the handle 202 relative to the housing 200 as discussed in greater detail below. Spring clips 205 or other suitable securing members are used to hold the handle 202 in this position in the housing 200.

Suitably secured to the longitudinally extending portion 206 of the handle 202 are a pair of rods 208 which, when mounted to the door 22, extend through the slots 210, 212 in the base flange plate 42 (see FIGS. 1–6) to permit some lateral motion of the rods 208 resulting from pivoting of the handle 202. The upper rod 208 through slot 210 is disposed between the face plate 24 and the control arm 158 of the arm link 150, adjacent to the control arm 158.

Two leaf springs 216 are suitably secured to the housing 200. The leaf springs 216 each bear upon a short portion of the rods 208 which extend onto the opposite side of the handle longitudinally extending portion 206 (only the upper spring 216 is shown in FIGS. 13 and 15), and therefore tend to bias the handle 202 back toward its neutral position when the handle 202 is pivoted clockwise during use as described below. (Please note that references herein to pivoting of the handles are made through reference to viewing the handles from above.)

Specifically, when the handle 202 is pulled to open the latched door 22, the force applied to the handle 202 by the person will initially not open the tightly latched door 22 but instead will naturally cause the handle to rotate slightly clockwise about the longitudinally extending portion 206. Such motion will cause the rods 208 to move laterally away from the face plate 24, engaging the control arm 158 of the arm link 150 to in turn pivot it clockwise (in the FIG. 5 orientation) so as to raise the driving arm 154 and thereby also cause the tie bar 28 and latch members 26 to move up, eventually to a unlatched position with the latch hooks 94 of each latch member 26 clear of the keepers 30. Continued pulling on the handle 202 will therefore result in the door 22 being slid to an open position away from the frame.

A suitable cam lock actuator 220 is also provided for controlling the cam lock 160 shown in FIG. 6. The actuator 220 includes a hub 222 receivable in a boss 224 in the housing 200 to suitably retain the actuator therein and to permit pivoting of the actuator 220 about the hub 222. An engageable finger 226 extends through a notch 228 in the side of the housing 200 to enable a person to selectively pivot the actuator 220 up and down as shown by arrow 230.

The actuator 220 also has an actuator flange 234 thereon which is receivable in a slot 236 (see FIG. 6) in the cam lock 160 so that the cam lock 160 and actuator 220 will pivot together, thereby enabling the locking of the lock 20 to be easily manually controlled by a person on the interior side of the door 22 by merely manipulating the engageable finger 226.

Protective plastic caps 240 may also be provided on the rods 208 and the actuator flange 234 to protect those components prior to mounting the housing and handle structure to a door 22, and to also prevent the rods 208 and flange 234 from scratching other components prior to mounting. Such caps 240 will generally be removed when mounting to the door 22.

Referring now to the structure on the exterior side of the door 22, a decorative housing 250 is provided with suitable reinforcing ribs therein for maintaining the structural integrity of the housing 250. Bosses 252 are provided in the housing 250, which bosses 252 are aligned with the bosses 201 of the interior housing 200 when the housings 200, 250 are secured to opposite sides of the door 22. Accordingly, screws may be extended through the bosses 201, 252 of one housing 200, 250 and into the bosses 252, 201 of the other housing 250, 200 to secure both housings 200, 250 on opposite sides of the door 22. For obvious security reasons, generally the head of such mounting screws is located and accessible from the interior side of the door 22.

As best shown in FIG. 18, the handle 254 is a looped member, including a reduced diameter portion 256 received in the housing 250, and more particularly having a longitudinally extending portion 258 disposed in suitable slots in the housing reinforcing ribs so as to permit slight pivoting of the handle 254 relative to the housing 250 as discussed in greater detail below.

The longitudinally extending portion 258 of the handle 254 also includes an offset portion 260 which provides additional space in the housing 250 to allow for inclusion of a suitable key lock structure in a boss 262 in the housing 250. Though not shown, it will be readily understood by those skilled in this art that a key lock may be used with the housing 250, which key lock may be secured to the cam lock 160 to permit pivoting therewith, but such pivoting from a locked position may therefore only be accomplished from the exterior side of the door 22 by an authorized person having an appropriate key as required by the key lock.

Spring clips 205 or other suitable securing members are used to hold the handle 254 in this position in the housing 250.

Suitably secured to the longitudinally extending portion 258 of the handle 254 are a pair of rods 264 which, when mounted to the door 22, extend through the slots 210, 212 in the base flange plate 42 (see FIGS. 1–6) to permit some lateral motion of the rods 264 resulting from pivoting of the handle 254. As with the rod 208 of the interior handle 202, the upper rod 264 through slot 210 is disposed between the face plate 24 and the control arm 158 of the arm link 150, adjacent to the control arm 158. Protective plastic caps 266 may also be provided on the rods 264 such as previously discussed.

Two leaf springs 268 are suitably secured to the housing 250. The leaf springs 268 each bear upon a short portion of the rods 264 which extend onto the opposite side of the handle longitudinally extending portion 258 (only the upper spring 268 is shown in FIGS. 16 and 18), and therefore tend to bias the handle 254 back toward its neutral position when the handle 254 is pivoted counterclockwise during use as described below. (As previously noted, references herein to pivoting of the handles are made through reference to viewing the handles from above.)

It should thus be appreciated that when the handle 254 is pulled to open the latched door 22, the force applied to the handle 254 by the person will initially not open the tightly latched door 22 but instead will cause the handle to rotate slightly counterclockwise about the longitudinally extending portion 258. Such motion will cause the rods 264 to move laterally away from the face plate 24, engaging the control arm 158 of the arm link 150 to in turn pivot it clockwise (in the FIG. 5 orientation) so as to raise the driving arm 154 and thereby also cause the tie bar 28 and latch members 26 to move up, eventually to a unlatched position with the latch hooks 94 of each latch member 26 clear of the keepers 30. Continued pulling on the handle 254 will therefore result in the door 22 being slid to an open position away from the frame.

It should thus be appreciated that the multipoint lock 20 as described herein will have numerous advantages as noted above. Still other aspects, objects, and advantages of the present invention can be obtained from a study of the specification, the drawings, and the appended claims.

We claim:

1. A modular multipoint lock assembly for securing a door in a closed position relative to a door frame, comprising:

a tie bar securable to a door for selected longitudinal movement between a securing position and a disengaged position;

a face plate securable to a door, said face plate having first and second latch member attachment sites with a selected spacing therebetween in the longitudinal direction of the movement of the tie bar;

first and second latch members releasably secured to the tie bar;

means for selectively adjustably securing the first and second latch members to the first and second latch member attachments sites for movement relative to the first and second latch member attachment sites;

means for selectively moving said tie bar between said securing position and said disengaged position;

a longitudinal keeper base having first and second keeper hook attachment sites with said selected spacing therebetween in the longitudinal direction of the movement of the tie bar, said keeper base being securable to a door frame; and first and second keeper hooks secured to the keeper base at the first and second keeper hook attachment sites;

whereby with a door in a closed position relative to a door frame said first and second latch members in a securing position cooperate with said first and second keeper hooks to prevent the door from being moved from its closed position.

2. A multipoint lock for securing a door in a closed position relative to a door frame, comprising:

a tie bar securable to a door for selected movement in a longitudinal direction between a securing position and a disengaged position;

first and second keepers securable to a door frame with a selected spacing therebetween;

first and second latch members selectively engageable with said first and second keepers with a door in a closed position; and means for securing said first and second latch members to said tie bar with said selected spacing therebetween, said securing means further including means for adjustably securing said latch members laterally relative to the longitudinal direction of movement of said tie bar, wherein said securing means for each of said latch members includes a fixed screw hole in said tie bar, a screw having a shaft threaded into said tie bar screw hole, said screw further having a head and tool-engageable means for turning said screw to locate said screw head in a selected position, and a slot in said latch member receiving said screw head, whereby said latch member is selectively securable in a lateral direction relative the longitudinal direction of movement of said tie bar by the selected position of said head.

3. A multipoint lock for securing a door in a closed position relative to a door frame, comprising:

a metal face plate securable over a groove in a side of a door;

a metal tie bar longitudinally movable in a groove in a side of a door between a securing position and a disengaged position;

first and second latch members secured to said tie bar; and means for securing said tie bar to said metal face plate at at least two locations to allow longitudinal movement of said tie bar relative to said plate, said securing means at each of said at least two locations including a plastic spacer between said face plate and said tie bar, said plastic spacer preventing metal to metal contact between said face plate and said tie bar and including an opening therethrough, a securing member extending through openings in said face plate and said tie bar and through said spacer opening, said securing member having heads at opposite ends thereof larger than the face plate and tie bar openings to secure the face plate, spacer, and tie bar therebetween.

4. The multipoint lock of claim 3, wherein said tie bar has a first selected thickness and said spacer has a second selected thickness, and further comprising a spacing portion in said securing member between one of said securing member heads and said face plate, said spacing portion having a thickness at least as great as the sum of the first and second selected thicknesses and extending through the openings in the tie bar and the spacer.

5. A multipoint lock for securing a door in a closed position relative to a door frame, comprising:

a longitudinal tie bar having opposite ends and securable to a door for selected longitudinal movement between a securing position and a disengaged position, said tie bar having means on both ends for securing to a latch member, said securing means comprising a securing hook at each end of said tie bar;

means for selectively moving said tie bar between said securing position and said disengaged position; and first and second latch members each having means on one end for cooperating with said tie bar securing means to secure said first and second latch members to said tie bar opposite ends for longitudinal movement with said tie bar, said latch member securing means comprising interengaging hooks cooperable with the tie bar securing hooks.

6. The multipoint lock of claim 5, further comprising a third latch member, wherein said latch members on opposite ends have interengaging hooks with said first latch member having the interengaging hook on one end cooperating with said tie bar securing means and the third latch member having the interengaging hook cooperating with the interengaging hook on the other end of the first latch member to secure said first and third latch members for longitudinal movement with said tie bar.

7. The multipoint lock of claim 5, further comprising first and second keeper hooks securable to a door frame whereby, with a door in a closed position relative to a frame, said first and second latch members in a securing position cooperate with said first and second keeper hooks to prevent the door from being moved from its closed position.

8. A control for a multipoint lock for securing a door in a closed position relative to a door frame, comprising:

a face plate securable over a groove in a side of a door;

a tie bar longitudinally movable in a groove in a side of a door between a securing position and a disengaged position, said tie bar having a first selected thickness and first and second latch members secured thereon:

means for securing said tie bar to said face plate in at least two locations to allow longitudinal movement of said tie bar relative to said plate, said securing means at each of said at least two locations including a longitudinal slot in said tie bar and a securing member having a longitudinal axis that is generally parallel with respect to the tie bar, each of said securing members having a body member extending substantially between opposite longitudinal ends of each securing member, said securing member body member being received in said tie bar longitudinal slot with parallel longitudinal sides cooperating with said tie bar longitudinal slot to guide said tie bar for longitudinal movement, and first and second fasteners at opposite longitudinal ends of each of said securing members and secured to said face plate with each of said body members having its parallel longitudinal sides substantially parallel to the direction of longitudinal movement of said tie bar relative to said face plate.

9. The control for a multipoint lock of claim 8 wherein said tie bar longitudinal slots are longer than said body members by a selected distance which is at least as great as the distance of longitudinal movement of the tie bar.

10. The control for a multipoint lock of claim 8, further comprising first and second latch members secured to said tie bar.

11. The control for a multipoint lock of claim 10, further comprising first and second keeper hooks securable to a door frame whereby, with a door in a closed position relative to a frame, said first and second latch members in a securing position cooperate with said first and second keeper hooks to prevent the door from being moved from its closed position.

12. The control for a multipoint lock of claim 8 wherein said securing member body members form bushings, and said control is secured to a side of a door by securing screws extending through said face plate and said body member bushings and into a door.

13. A releasable multipoint latch for securing a door in a closed position relative to a door frame, comprising:

a tie bar securable to a door for selected longitudinal vertical movement between a securing position and a disengaged position, said tie bar having first and second latch members secured thereon with a selected spacing therebetween;

a pivot link pivotable about a substantially horizontal axis, said link having first and second arms, said first arm being drivably engageable with said tie bar to selectively move said tie bar vertically toward its disengaged position when said pivot link is pivoted in a first direction about its horizontal axis;

a handle member securable to a door for pivoting in a first direction about a substantially vertical axis when said handle member is pulled horizontally toward opening a door;

means for drivably engaging said handle member with said pivot link second arm whereby pivoting of said handle member in the first direction about its vertical axis pivots said pivot link in the first direction about its horizontal axis;

first and second keeper hooks securable to a door frame with said selected spacing therebetween; and means for biasing said tie bar toward said securing position;

whereby with a door in a closed position relative to a door frame said first and second latch members in the securing position cooperate with said first and second keeper hooks to prevent the door from being moved from its closed position.

14. The latch of claim 13, wherein said biasing means comprises a spring biasing said handle to bias said drivably engaging means to bias said pivot link toward pivoting in a direction opposite said first direction to bias said tie bar toward said securing position.

15. A structure for assisting in properly mounting a keeper hook to a closure frame, said keeper hook when mounted to a closure frame cooperating with a moveable latch in a housing along a side of a closure slidably movable in said closure frame to a closed position in which said latch cooperates with said keeper hook with the movable latch being accessible by a keeper hook through an opening in the latch housing, comprising:

a keeper hook secured to a base, said base being securable along one side to a closure frame and including a portion projecting from said one side for visibly marking a closure frame when said base is pressed against the closure frame; and an alignment guide adapted to support the keeper hook in a cooperative position with the latch when said base is not secured to a closure frame, said guide including a U-shaped member having two upright legs connected by a bottom cross member and an outer surface substantially adapted to conform to the latch housing opening, whereby the guide is adapted to be received in the housing opening and is adapted to receive the keeper hook between the two U-shaped member legs and to support the keeper hook by said bottom cross member in a position substantially cooperating with a movable latch.

* * * * *